US012442063B2

(12) United States Patent
Kim

(10) Patent No.: US 12,442,063 B2
(45) Date of Patent: Oct. 14, 2025

(54) COATED BODY

(71) Applicant: ATTOMETAL TECH PTE. LTD., Singapore (SG)

(72) Inventor: Choongnyun Paul Kim, Seoul (KR)

(73) Assignee: ATTOMETAL TECH PTE. LTD., Singapore (SG)

( * ) Notice: Subject to any disclaimer, the term of this patent is extended or adjusted under 35 U.S.C. 154(b) by 429 days.

(21) Appl. No.: 17/773,621

(22) PCT Filed: Sep. 16, 2020

(86) PCT No.: PCT/KR2020/012499
§ 371 (c)(1),
(2) Date: May 2, 2022

(87) PCT Pub. No.: WO2021/091074
PCT Pub. Date: May 14, 2021

(65) Prior Publication Data

US 2022/0389547 A1 Dec. 8, 2022

(30) Foreign Application Priority Data

Nov. 6, 2019 (KR) ..... 10-2019-0140583

(51) Int. Cl.
*C22C 45/02* (2006.01)
*B22F 1/00* (2022.01)
(Continued)

(52) U.S. Cl.
CPC ..... *C22C 45/02* (2013.01); *B22F 1/00* (2013.01); *B22F 1/08* (2022.01); *C22C 38/22* (2013.01);
(Continued)

(58) Field of Classification Search
CPC ..... C22C 38/22; C22C 45/08; C22C 45/008; C23C 4/06–10
See application file for complete search history.

(56) References Cited

U.S. PATENT DOCUMENTS 8,524,053 B2 * 9/2013 Farmer ..... C23C 28/321 204/298.13
9,328,404 B2 * 5/2016 Saw ..... B22F 9/04
(Continued)

FOREIGN PATENT DOCUMENTS

CN 102041467 A * 5/2011
CN 103302287 A * 9/2013
(Continued)

OTHER PUBLICATIONS

Quora, "Screw Injection Diameter", NPL, retrieved on Sep. 9, 2024, https://www.quora.com/What-is-the-screw-diameter-of-an-injecion-molding-machine#. (Year: 2017).*
(Continued)

*Primary Examiner* — Sally A Merkling
*Assistant Examiner* — Austin Pollock
(74) *Attorney, Agent, or Firm* — Harvest IP Law, LLP

(57) ABSTRACT

Provided is a coated body including a base member coated with an iron-based amorphous alloy powder capable of maintaining an amorphous structure even after a coating process, such that the durability, surface hardness, and friction of the base member may be improved. The coated
(Continued)

body includes the base member and a coating layer which is formed of an iron-based amorphous alloy and provided on a surface of the base member.

10 Claims, 10 Drawing Sheets

(51) Int. Cl.
*B22F 1/08* (2022.01)
*C22C 38/22* (2006.01)
*C23C 4/06* (2016.01)
*C23C 4/10* (2016.01)

(52) U.S. Cl.
CPC ..... *C23C 4/06* (2013.01); *C23C 4/10* (2013.01); *C22C 2200/02* (2013.01)

(56) References Cited

U.S. PATENT DOCUMENTS

| | | | | |
|---|---|---|---|---|
| 10,131,978 | B2 * | 11/2018 | Croopnick | C23C 24/04 |
| 10,308,999 | B2 * | 6/2019 | Chou | C22C 38/005 |
| 10,337,088 | B2 * | 7/2019 | Saw | C22C 33/003 |
| 11,078,560 | B2 * | 8/2021 | Kang | C23C 4/08 |
| 2007/0295429 | A1 * | 12/2007 | Yi | C22C 45/02 148/403 |
| 2010/0084052 | A1 * | 4/2010 | Farmer | C23C 28/321 427/591 |
| 2013/0263973 | A1 | 10/2013 | Kurahashi | |
| 2014/0009872 | A1 * | 1/2014 | Prest | C22C 38/54 361/679.01 |
| 2014/0010968 | A1 * | 1/2014 | Prest | C23C 4/02 427/455 |
| 2016/0047028 | A1 * | 2/2016 | Kim | C23C 4/12 427/419.7 |

FOREIGN PATENT DOCUMENTS

| | | | | | |
|---|---|---|---|---|---|
| CN | 103898434 | A | * | 7/2014 | |
| CN | 105088108 | A | * | 11/2015 | |
| CN | 105256259 | A | * | 1/2016 | |
| CN | 106995906 | A | | 8/2017 | |
| CN | 107527702 | A | * | 12/2017 | C22C 45/02 |
| CN | 108546908 | A | | 9/2018 | |
| CN | 108624827 | A | * | 10/2018 | C22C 33/003 |
| CN | 110306189 | A | * | 10/2019 | |
| JP | S-61569 | A | * | 1/1986 | |
| JP | 2009270152 | A | * | 11/2009 | |
| KR | 1020120139821 | A | | 12/2012 | |
| KR | 2014123743 | A | * | 10/2014 | |
| KR | 1020160039594 | A | | 4/2016 | |
| KR | 20160107486 | A | | 9/2016 | |
| KR | 20180050951 | A | * | 5/2018 | |

OTHER PUBLICATIONS

Buehler, "Vickers Hardness Testing", Nov. 16, 2021, retrieved from internet on Dec. 6, 2024; https://www.buehler.com/blog/vickers-hardness-testing/ (Year: 2021).*

* cited by examiner

【Figure 1】
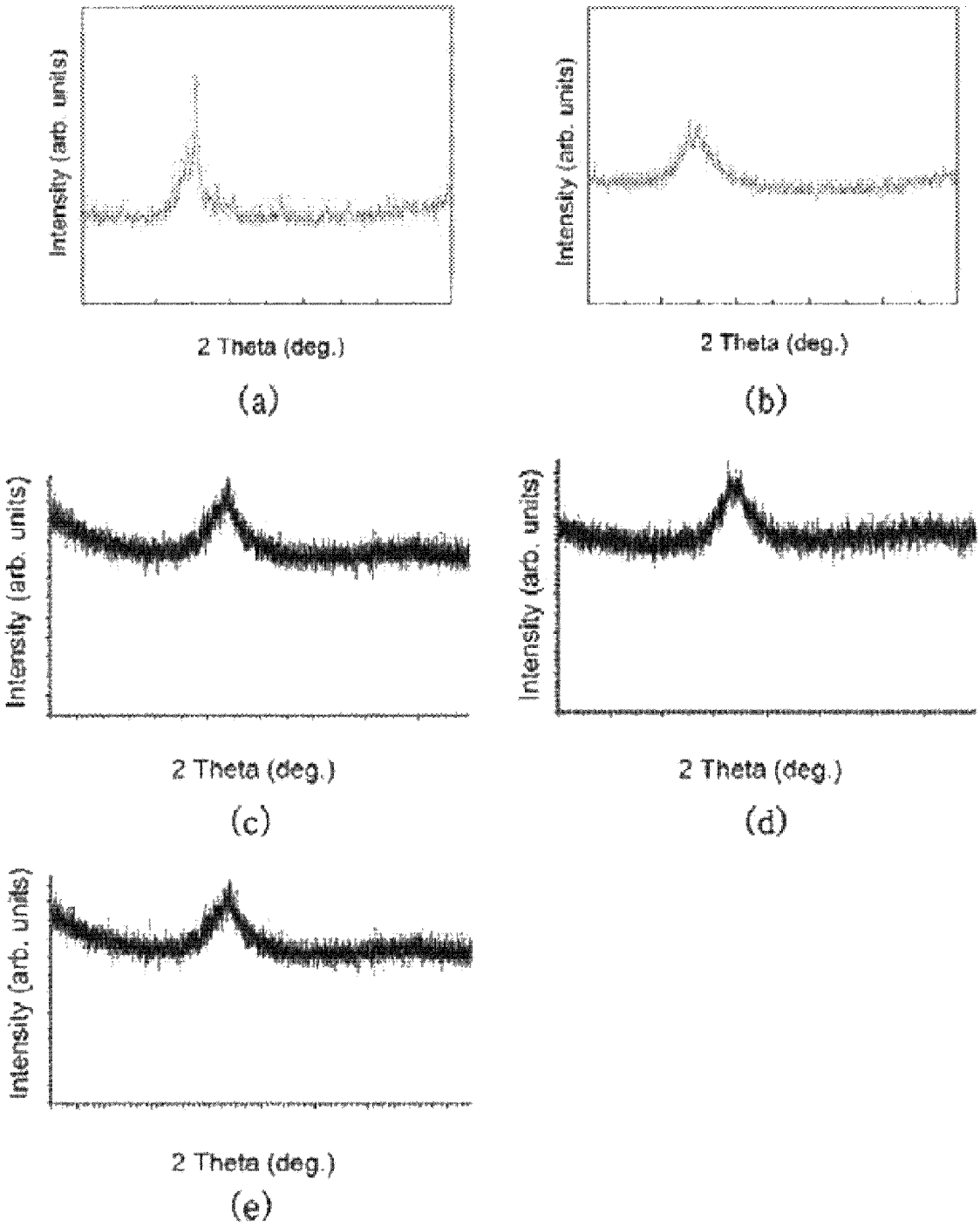

【Figure 2】
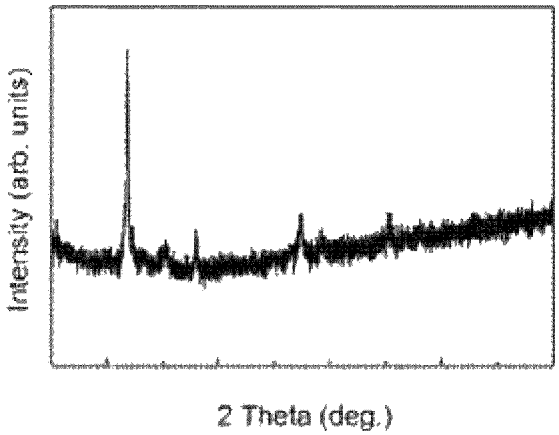
(a)
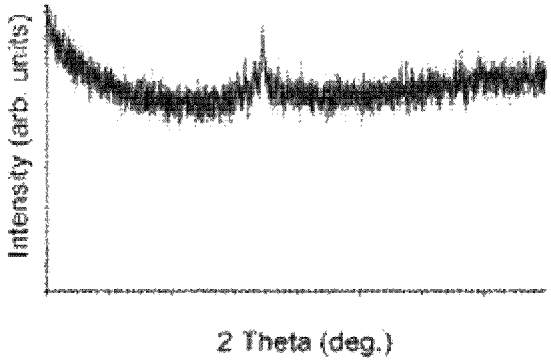
(b)
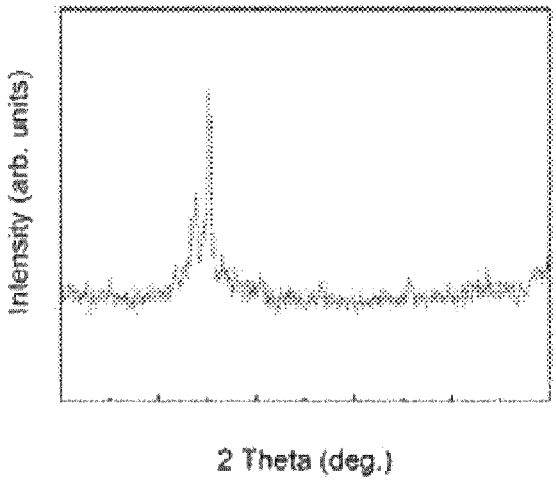
(c)

【Figure 3】
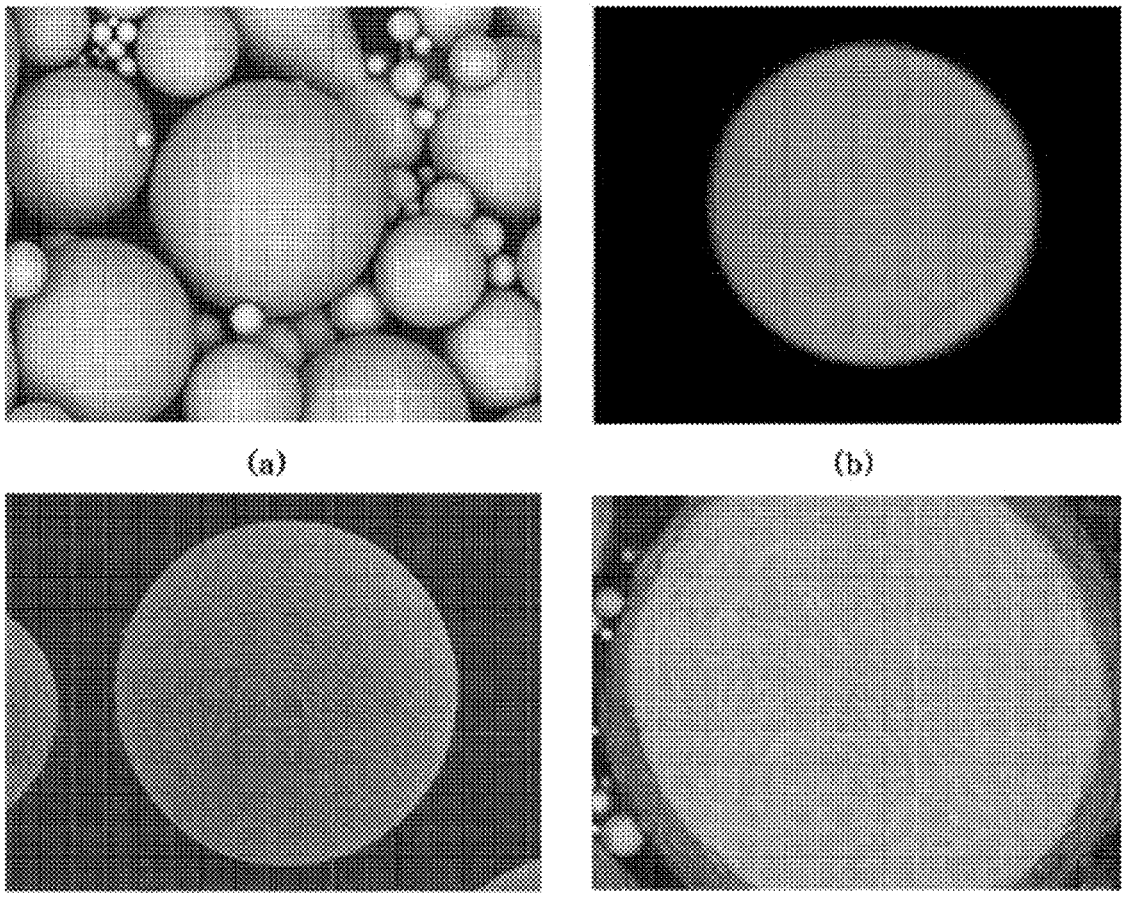
(a) (b) (c) (d)

【Figure 4】
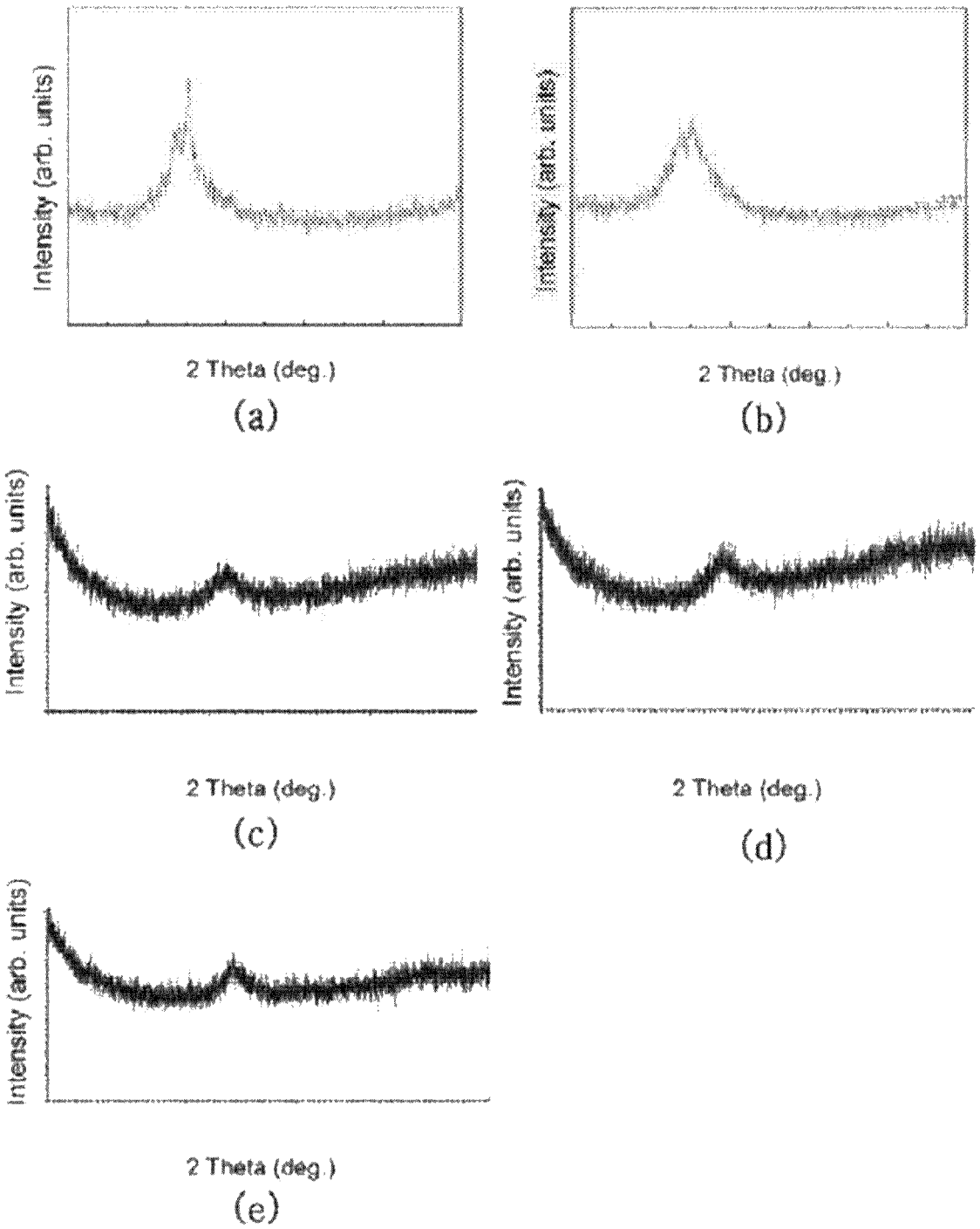

【Figure 5】
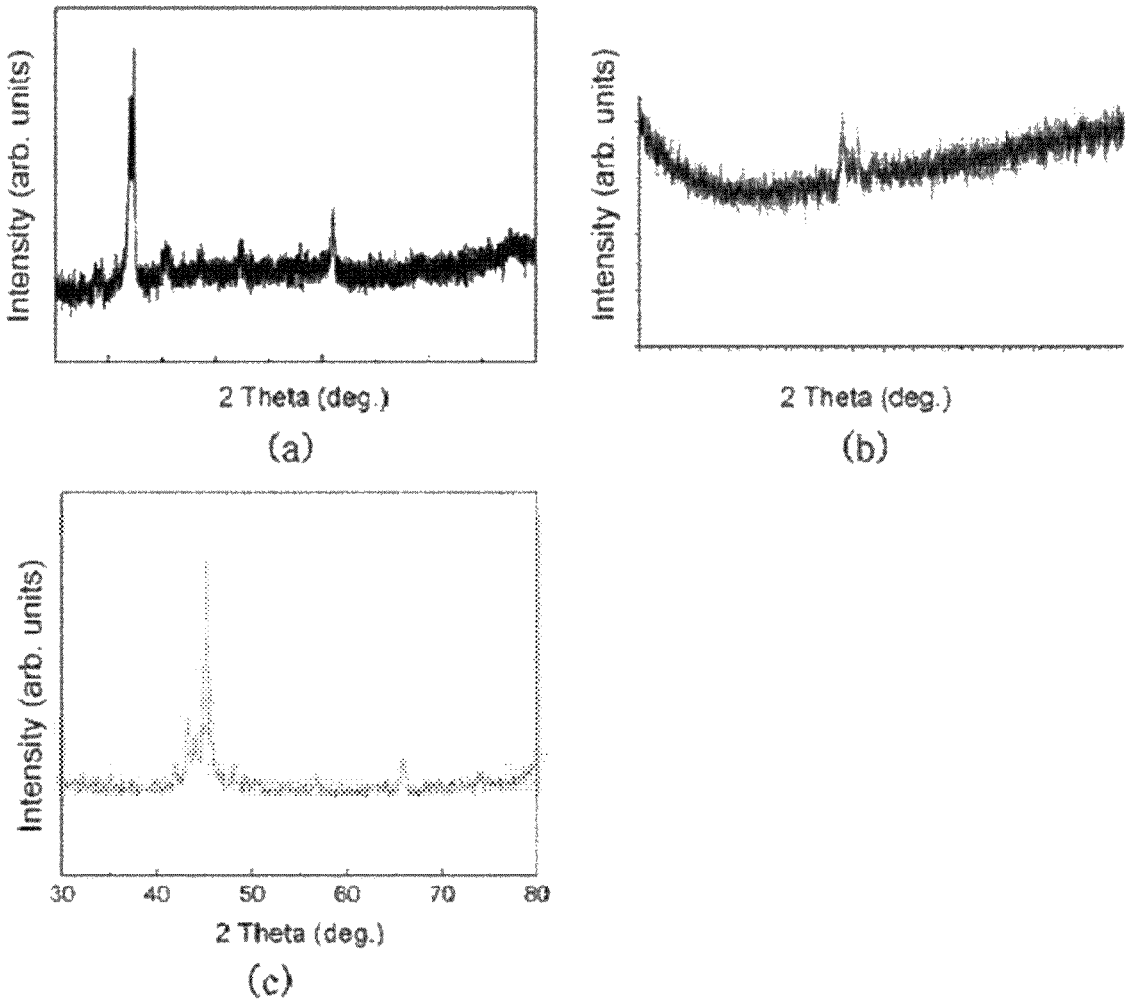

【Figure 6】
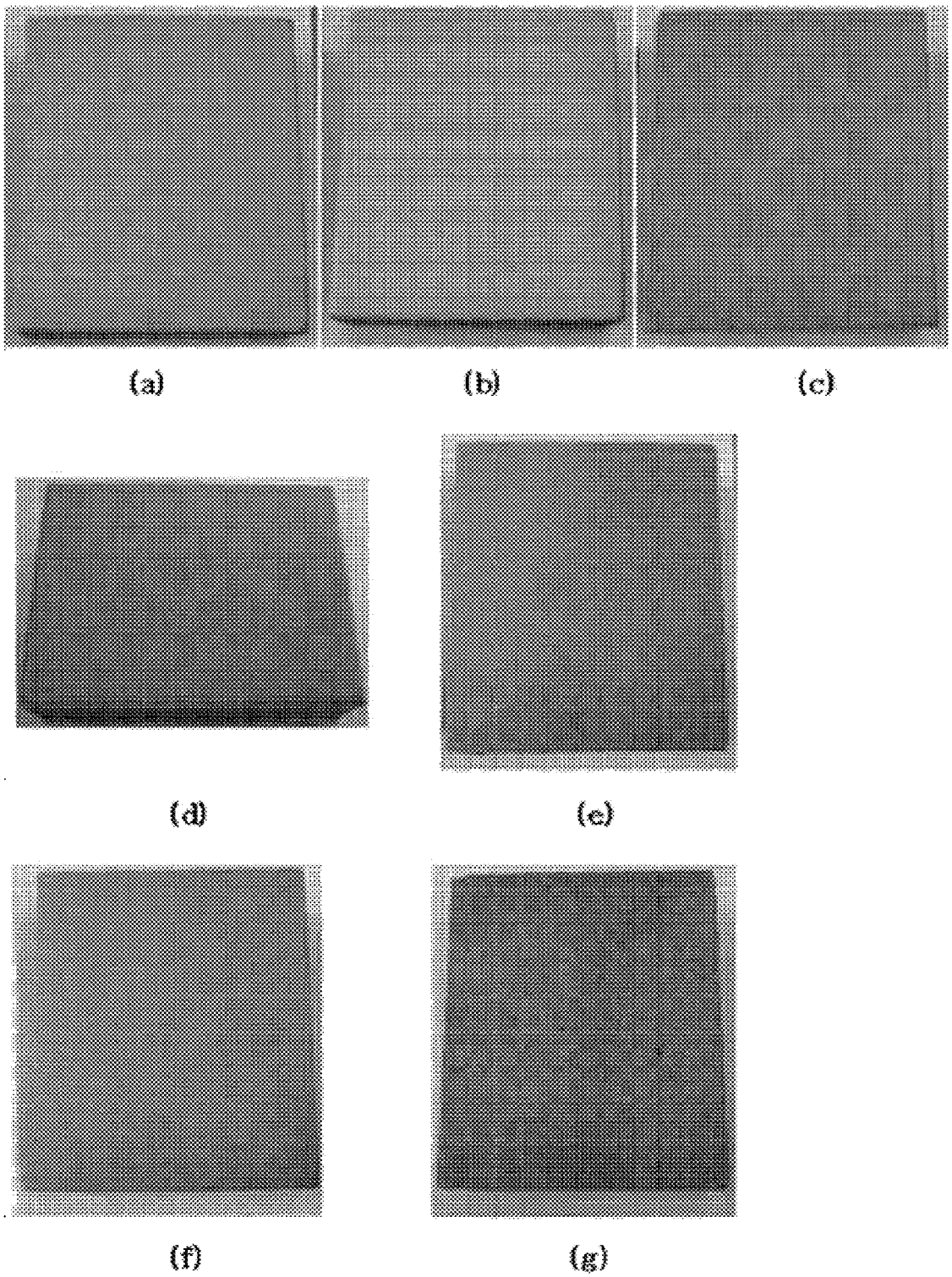

【Figure 7】
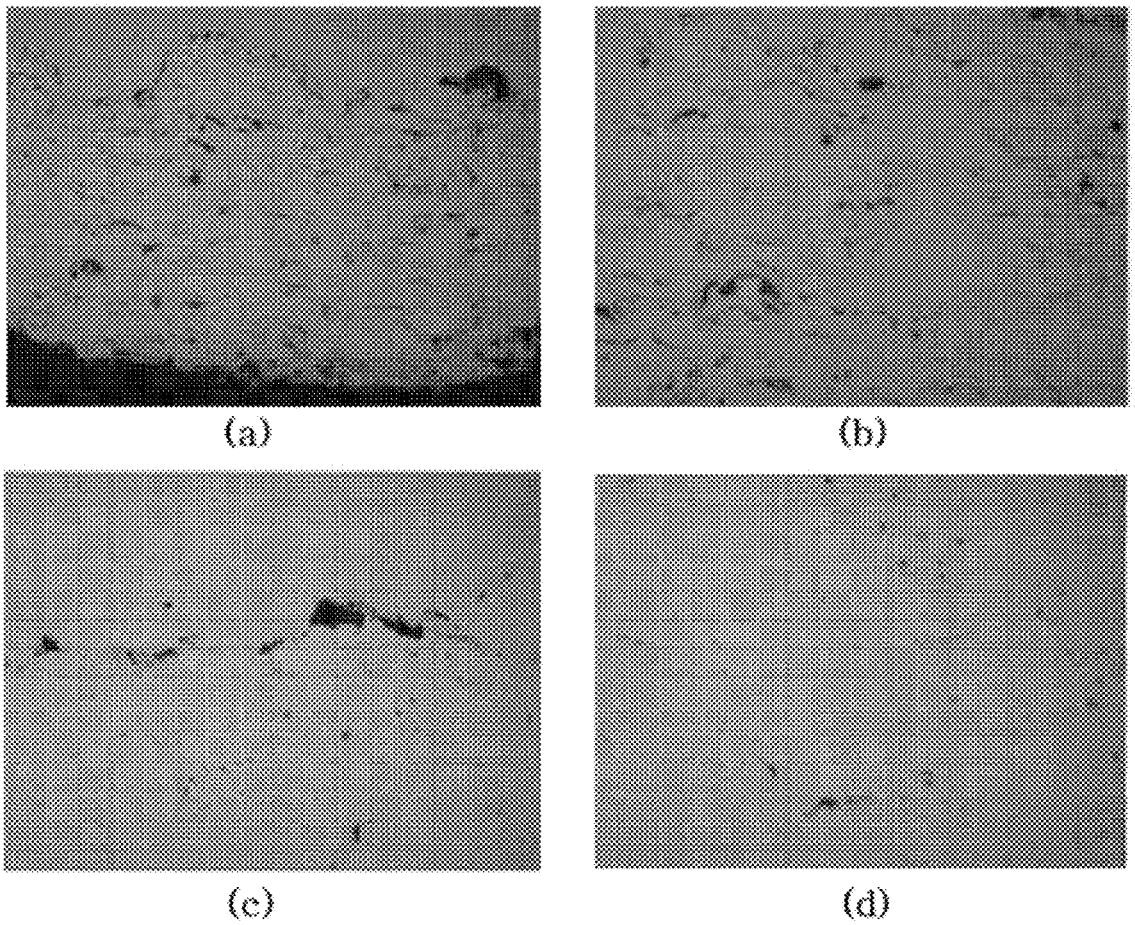

【Figure 8】
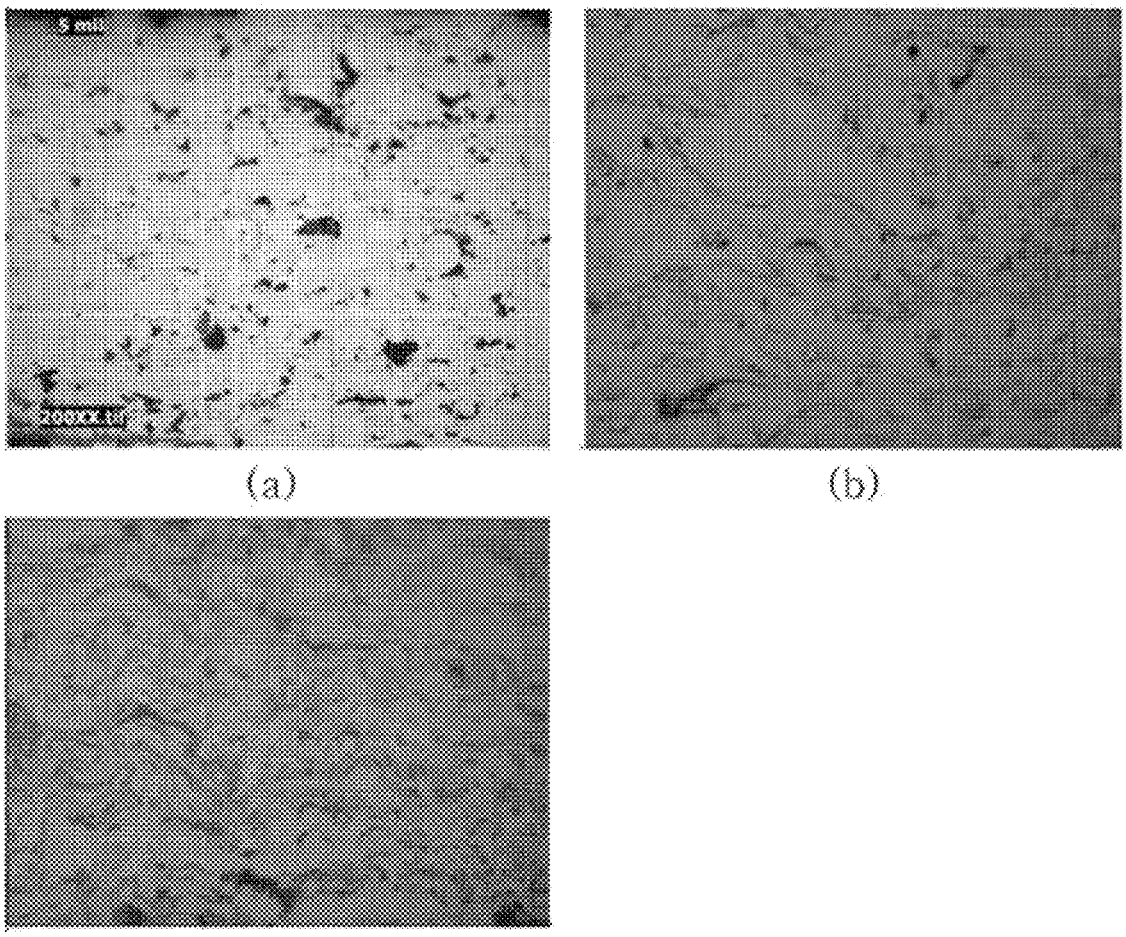

【Figure 9】
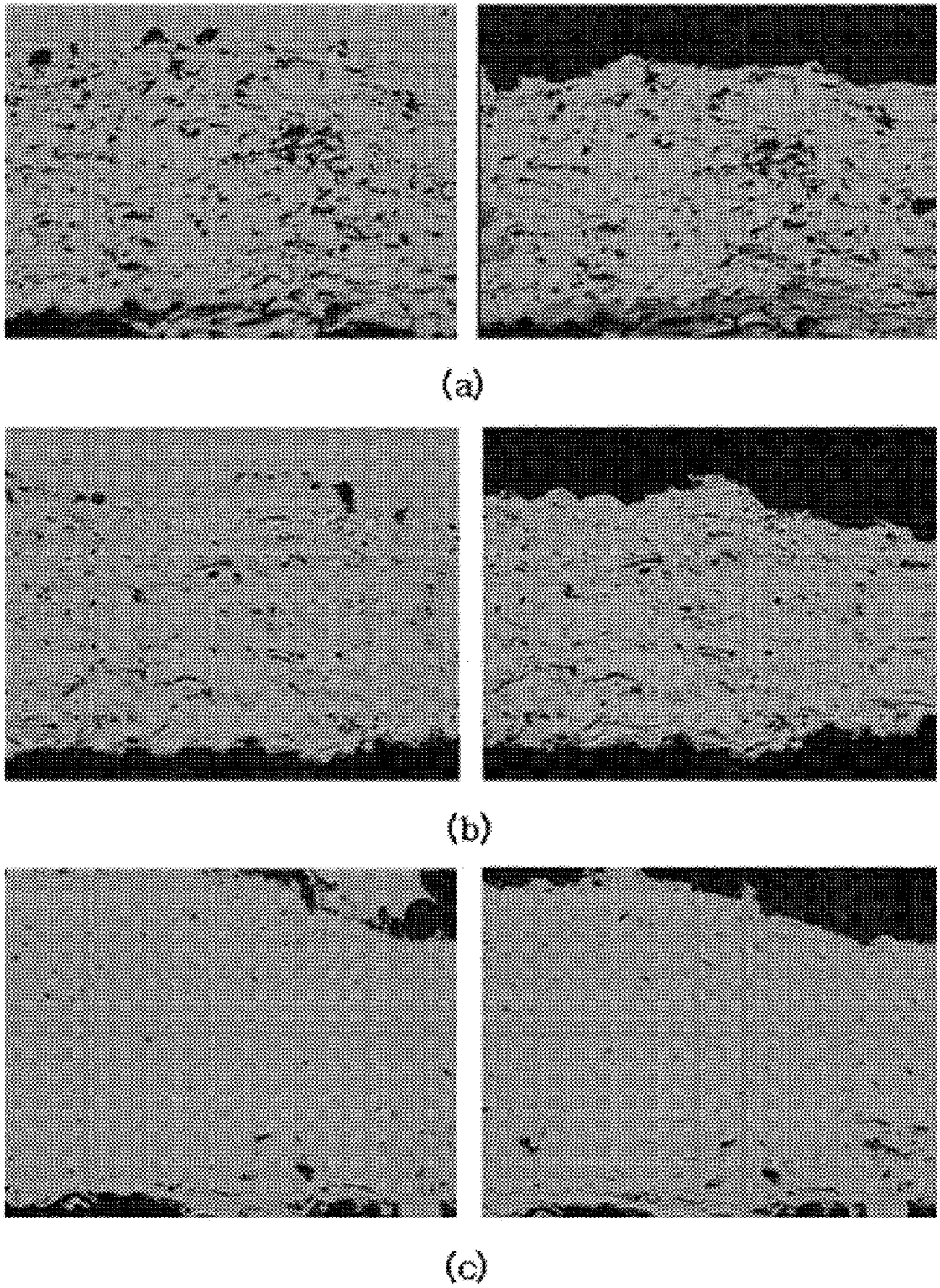

【Figure 10】
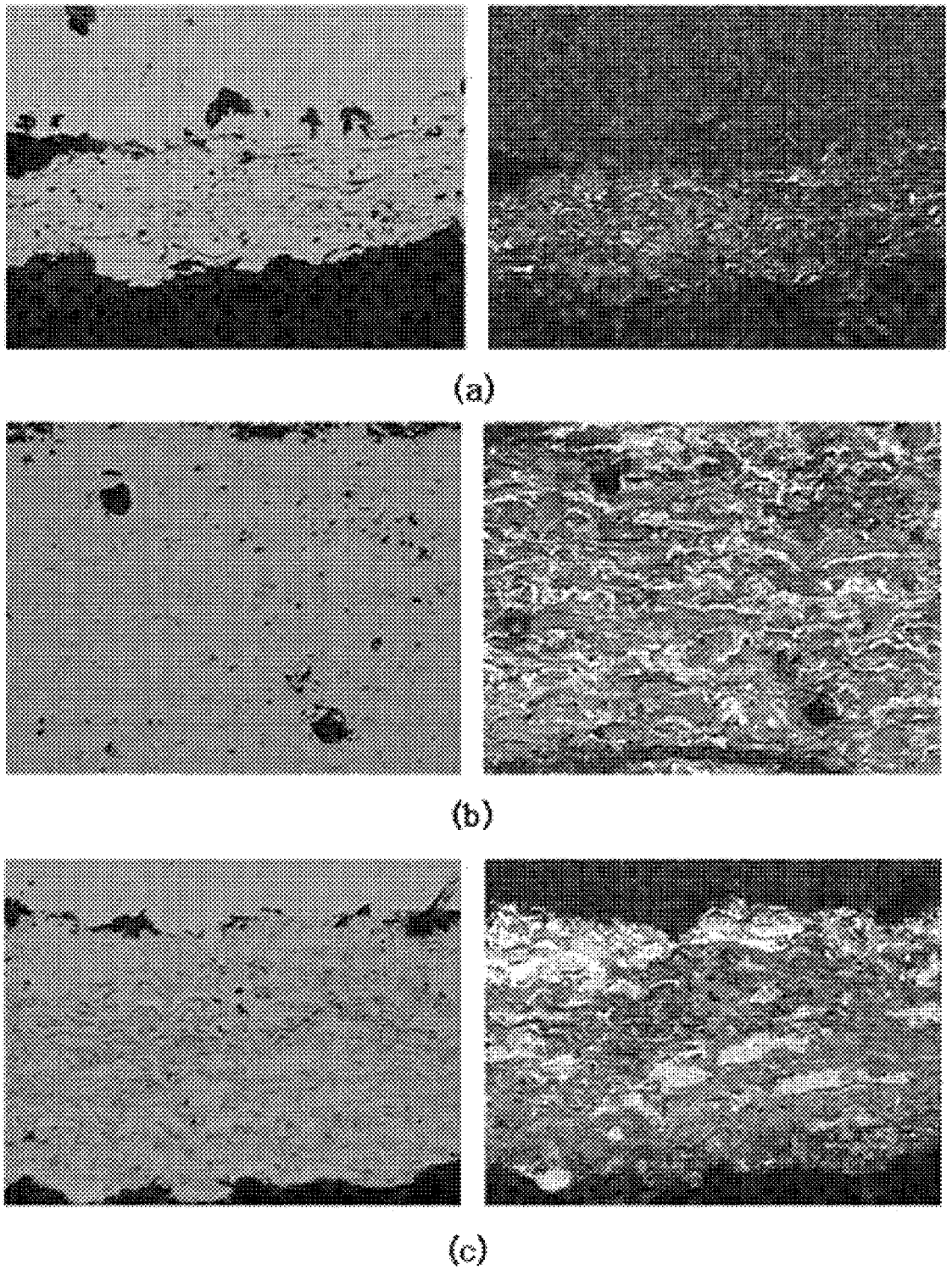
(a)
(b)
(c)

COATED BODY

CROSS REFERENCE TO RELATED APPLICATIONS

This application is a National Stage of International Application No. PCT/KR2020/012499 filed Sep. 16, 2020, claiming priority based on Korean Patent Application No. 10-2019-0140583 filed Nov. 6, 2019, the disclosures of which are incorporated herein by reference in their entireties.

TECHNICAL FIELD

The present disclosure relates to a coated body, and more particularly, to the durability, corrosion resistance, and friction of a base member which is coated with an iron-based amorphous alloy powder capable of maintaining an amorphous structure even after a coating process.

BACKGROUND ART

Various industrial tools, including machine tools, and household tools, are required to satisfy strict requirements regarding effective lifespan and wear resistance. To guarantee physical properties for these physical requirements, coatings based on titanium nitride, titanium carbide, and titanium carbonitride have long been used as wear-resistant layers. Recently, there have been attempts to improve chemical, electrical, and mechanical properties of coatings by applying amorphous alloys to the coatings.

However, when application products are fabricated using amorphous alloy powder, that is, coated bodies are fabricated by spraying amorphous alloy powder on bodies, crystallization rather than amorphization occurs after the alloy powder is melted, and thus it is difficult to manufacture application products utilizing amorphous characteristics. In this case, the coating density of the application products is not good, and when the application products are used in corrosive environments requiring corrosion resistance, foreign substances may penetrate the application products.

DISCLOSURE

Technical Problem

An object according to an aspect of the present disclosure is to provide a coated body including: a base member; and a coating layer formed of an iron-based amorphous alloy and provided on the surface of the base member to improve properties of the base member such durability, corrosion resistance, friction characteristics, and wear characteristics.

Technical Solution

To achieve the object, an aspect of the present disclosure provides a coated body including:

a base member; and a coating layer formed of an iron-based amorphous alloy and provided on a surface of the base member, wherein the iron-based amorphous alloy has an amorphous structure and includes iron, chromium, and molybdenum as main components.

In this case, the iron-based amorphous alloy may include: 25.4 to 55.3 parts by weight of chromium and 35.6 to 84.2 parts by weight of molybdenum, based on 100 parts by weight of iron, and the iron-based amorphous alloy may further include at least one selected from carbon and boron.

The coating layer may be formed of powder of the iron-based amorphous alloy through a spray coating process.

The coating layer may have a thickness of 0.01 mm to 0.5 mm, and the base member may have a thickness of at least 3 mm.

The powder of the iron-based amorphous alloy may have an amorphous phase fraction of 90 volume % to 100 volume %.

When the coating layer is formed of the powder of the iron-based amorphous alloy through the spray coating process, the coating layer may have an amorphous phase fraction of 90 volume % to 100 volume %.

The iron-based amorphous alloy may have a Vickers hardness (Hv 0.2) of 700 to 1,500.

The iron-based amorphous alloy may have a friction coefficient of 0.0005μ to 0.08μ under a load of 100 N, and 0.01μ to 0.12μ under a load of 1,000 N.

The iron-based amorphous alloy may further include one selected from the group consisting of tungsten, cobalt, yttrium, manganese, silicon, aluminum, niobium, zirconium, phosphorus, nickel, scandium, titanium, copper, cobalt, carbon, and mixtures thereof.

The base member may have a material selected from a metal, cemented carbide, a cermet, a ceramic, a plastic, and a fiber composite.

One or both of boride and carbide may be included in the coated body, and the total content of boride and carbide in the coated body may be 3 to 8 parts by weight based on 100 parts by weight of iron.

The boride and the carbide may be derived from boron and carbon of powder of the iron-based amorphous alloy.

Advantageous Effects

According to embodiments of the present disclosure, the base member of the coated body is coated with an amorphous iron-based alloy layer and is thus capable of maintaining an amorphous structure even after being coated, such that the properties of the base member such as durability, corrosion resistance, friction characteristics, and wear characteristics may be improved.

In addition, according to embodiments of the present disclosure, the coated body is coated with an iron-based amorphous alloy powder and thus has a good amorphous forming ability and a high amorphous phase fraction.

DESCRIPTION OF DRAWINGS

FIGS. 1A to 1E are XRD graphs of iron-based amorphous alloy powder particles which are used as coating materials for bodies according to Examples 1, 3, 6, 7, and 8 of the present disclosure, respectively.

FIGS. 2A to 2C are XRD graphs of iron-based alloy powder particles which are used as coating materials for bodies according to Comparative Examples 1, 5, and 7, respectively.

FIGS. 3A to 3D are SEM analysis images, FIG. 3A illustrating an iron-based amorphous alloy powder used as a coating material for a body according to Example 7 of the present disclosure, FIG. 3B illustrating a cross-section of the iron-based amorphous alloy powder; FIG. 3C illustrating an iron-based alloy powder used as a coating material for a body according to Comparative Example 7, and FIG. 3D illustrating a cross-section of the iron-based alloy powder.

FIGS. 4A to 4E are XRD graphs of specimens of coatings of coated bodies of the present disclosure, the coating specimens being obtained respectively according to Examples 9, 11, 14, 15, and 16 by respectively using iron-based amorphous alloy powder particles of Examples 1, 3, 6, 7, and 8.

FIGS. 5A to 5C are XRD graphs of specimens of coatings of coated bodies of comparative examples, the coating specimens being obtained respectively according to Comparative Examples 8, 12, and 14 by respectively using iron-based alloy powder particles of Comparative Examples 1, 5, and 7.

FIGS. 6A to 6C are surface images of sprayed coatings formed on bodies by spraying iron-based amorphous alloy powder particles of Examples 1, 7, and 8 of the present disclosure, and FIGS. 6D to 6G are surface images of sprayed coatings formed on bodies by spraying alloy powder particles of Comparative Examples 1, 3, 5, and 7.

FIGS. 7A to 7D are optical microscopic images (magnification: 200 times) of cross-sections of sprayed coating specimens of Examples 9, 11, 14, and 16 of the present disclosure which are formed on bodies by using iron-based amorphous alloy powder particles of Examples 1, 3, 6, and 8 of the present disclosure as coating materials.

FIGS. 8A to 8C are optical microscopic images (magnification: 200 times) of cross-sections of sprayed coating specimens of Comparative Examples 8, 11, and 14 which are formed on bodies by using alloy powder particles of Comparative Examples 1, 4, and 7 as coating materials.

FIGS. 9A to 9C are optical microscopic images (magnification: 200 times) of uncorroded and corroded cross-sections of sprayed coating specimens of Examples 10, 12, and 15 of the present disclosure which are formed on bodies by using iron-based amorphous alloy powder particles of Examples 2, 4, and 7 of the present disclosure as coating materials.

FIGS. 10A to 10C are optical microscopic images (magnification: 200 times) of uncorroded and corroded cross-sections of sprayed coating specimens of Comparative Examples 8, 11, and 13 which are formed on bodies by using alloy powder particles of Comparative Examples 2, 4, and 6 as coating materials.

BEST MODE

1) Since shapes, sizes, percentages, angles, numbers, etc. are roughly illustrated in the accompanying drawings, some variations thereof are allowed. 2) Since the drawings are drafted from an observer's perspective, the direction or position for describe the drawings may be variously changed according to the observer's position. 3) The same reference numerals will be used for the same portions even in different drawings.

4) The terms "comprise," "have," "composed of," etc. may be interpreted as allowing the addition of any other portion unless the word "only" is used together with the terms. 5) Any element used in a singular form may also be interpreted to indicate plural forms. 6) Although shapes, comparisons in size, position relations, etc. are not described with "about," "substantially," etc., they may be interpreted to cover a general scope of tolerance.

7) Although the terms "after ~," "before ~," "subsequently," "following," "this time," etc., are used, the terms are not intended to limit a temporal order. 8) The terms "first," "second," "third," etc. are used selectively, interchangeably, or repeatedly for only ease of distinguishment, and are not interpreted as a limited meaning.

9) Where a position relation between two portions is described with "on ~," "above ~," "below ~," "beside ~," "on a side ~," "between ~," etc., there may be at least one other portion between the two portions unless they are used with "directly."

10) The expression "a part 'or' another part is electrically connected to something" may be interpreted to cover any combination of the parts as well as one of the parts, and the expression "'one of' a part 'or' another part is electrically connected to something" may be interpreted that either the part or the other part is electrically connected to something.

Hereinafter, embodiments of the present disclosure will be described in detail.

In the present specification, the term "amorphous" or "amorphousness," which is generally also called non-crystalline or amorphous phase, is used to refer to a phase of a solid in which crystals are not formed, that is, a phase that does not have a regular structure.

Furthermore, in the present specification, the term "coating layer" includes a coating film or the like formed of iron-based amorphous alloy powder usually by a spray coating method.

Furthermore, in the present specification, the term "iron-based amorphous alloy powder" refers to a powder which includes iron in the largest amount by weight and of which the phase is substantially amorphous as a whole, for example, with an amorphous phase fraction of 90% or more, rather than being partially amorphous.

According to an embodiment of the present disclosure, a coated body includes: a base member; and a coating layer formed of an iron-based amorphous alloy and provided on the surface of the base member.

<Base Member of Coated Body>

The thickness of the base member may be 10 mm to 100 mm, and preferably 30 mm to 80 mm, by considering the coating thickness of the iron-based amorphous alloy according to the present disclosure. If the thickness of the base member is less than 3 mm, the thickness of a material constituting the coated body is excessively small and may be less than a limit. In this case, the basic performance of the coated body may deteriorate, and the base member may be distorted by heat, etc.

To control the thickness of the base member, for example, a method or equipment such as mold thickness adjustment or CNC milling may be used, and among these, CNC milling may preferably be used to reduce the thickness of the base member. In addition, a material used as a base member of a coated body in the related art, such as a metal, cemented carbide, a cermet, a ceramic, a fiber composite (CFRP, GFRP, or the like), or a plastic, may be used as a material of the base member.

The metal may include, for example, Ti, Al, V, Mo, Fe, Cr, Sn, Zr, or Mg, but is not limited thereto.

The Hv hardness of the base member may be 100 to 400, and preferably 200 to 300.

<Coating Layer of Coated Body>

Hereinafter, an iron-based amorphous alloy layer, a coating layer formed of the iron-based amorphous alloy and provided on the surface of the base member of the coated body, will be described.

The iron-based amorphous alloy includes iron, chromium, and molybdenum as main components, and an amorphous phase is not simply included in the iron-based amorphous alloy powder but occupies substantially the majority thereof, for example, in the amount of 90% or more.

The iron-based amorphous alloy is provided from an iron-based amorphous alloy powder, which includes iron, chromium, and molybdenum, and also at least one selected from carbon and boron.

When the iron-based amorphous alloy powder is manufactured as an alloy powder having a high amorphous phase fraction by, for example, an atomizing method, the amorphous phase fraction is 90% or more, 95% or more, 99% or more, 99.9% or more, and substantially 100%. That is, the iron-based amorphous alloy powder having a high amorphous phase fraction as described above may be manufactured according to the rate of cooling.

The iron-based amorphous alloy powder may be manufactured in various particle shapes and diameters without limitations, and may include a first component, a second component, a third component, and a fourth component for making the iron-based amorphous alloy described above.

The first component is iron (Fe) for improving the rigidity of a coating of the alloy powder, the second component is chromium (Cr) for improving the physical and chemical properties of the alloy powder coating such as wear resistance and corrosion resistance, and the second component may be included in an amount of 55.3 parts by weight or less and preferably in an amount of 25.4 parts by weight to 55.3 parts by weight based on 100 parts by weight of the first component.

The third component is molybdenum (Mo) for imparting wear resistance and corrosion resistance as well as friction resistance, and may be included in an amount of 84.2 parts by weight or less and preferably 35.6 parts by weight to 84.2 parts by weight based on 100 parts by weight of the first component.

The fourth component includes at least one or both of carbon (C) and boron (B) to improve the ability to form an amorphous phase by atomic size mismatch or packing ratio efficiency with the other components, and may preferably be included in an amount of 23.7 parts by weight or less, 1.7 parts by weight to 23.7 parts by weight, 3.4 parts by weight to 23.7 parts by weight, or 3.4 parts by weight to 15 parts by weight, based on 100 parts by weight of the first component.

In addition to the above-mentioned components, the iron-based amorphous alloy powder may intentionally or unintentionally include an additional component selected from the group consisting of tungsten, cobalt, yttrium, manganese, silicon, aluminum, niobium, zirconium, phosphorus, nickel, scandium, and mixtures thereof. The total content of the additional component is less than 1.125 parts by weight, 1.000 parts by weight, or 0.083 parts by weight based on 100 parts by weight of iron. That is, when the weight contents of the first component, the second component, the third component, the fourth component, and the additional component are within the ranges described above, the iron-based amorphous alloy powder is considered as an iron-based alloy powder according to an embodiment of the present disclosure.

In addition, the additional component may be used in an amount of 0.9 parts by weight or less, and preferably 0.05 parts by weight or less. If the content of the additional component is outside the range, the amorphous forming ability of the iron-based amorphous alloy powder may be markedly reduced. The iron-based amorphous alloy powder has good properties such as density, strength, wear resistance, friction resistance, and corrosion resistance owing to a high amorphous phase fraction.

The iron-based amorphous alloy powder may have an average particle size within the range of 1 μm to 150 μm, but is not limited thereto, and the particle size of the iron-based amorphous alloy powder may be adjusted by sieving according to uses.

For example, when a spray coating method is used, the particle size of the iron-based amorphous alloy powder may be adjusted to be within the range of 16μ to 54μ by sieving.

The iron-based amorphous alloy powder may have, for example, a density within the range of about 7±0.5 g/cc, but is not limited thereto.

The iron-based amorphous alloy powder may have a powder hardness of about 800 Hv to about 1500 Hv, but is not limited thereto.

The iron-based amorphous alloy powder maintains the above-described amorphous fraction even when the iron-based amorphous alloy powder is melted again or exposed to high temperature and is cooled again to solid. In this case, the amorphous fraction (a) of the iron-based amorphous alloy powder manufactured by an atomizing method and the amorphous fraction (b) of an alloy made by melting the iron-based amorphous alloy powder at a temperature equal to or greater than the melting point of the alloy and then re-cooling the iron-based amorphous alloy powder may satisfy the following condition.

$$0.9 \leq b/a \leq 1 \quad \text{[Condition 1]}$$

Here, a method of manufacturing the alloy by melting the iron-based amorphous alloy powder to a temperature above the melting point of the alloy and then re-cooling the melted iron-based amorphous alloy powder may be used to derive b. For example, a spray coating method may be used to drive b.

In addition, the b/a ratio in Condition 1 may be preferably within the range of 0.95 to 1, more preferably within the range of 0.98 to 1, and even more preferably within the range of 0.99 to 1.

In addition, the iron-based amorphous alloy powder has good electrical properties and may be manufactured as a soft magnetic powder.

The iron-based amorphous alloy powder may be used to form the coating layer through a general coating process, for example, a spray coating process such as a high velocity oxygen fuel (HVOF) spray coating process, a plasma spray coating process, or an arc wire spray coating process. In this case, the coating layer has an amorphous structure and may be provided on the base member of the coated body to markedly improve physical properties such as hardness, wear resistance, corrosion resistance, elasticity, and friction resistance.

The iron-based amorphous alloy powder may maintain an amorphous structure even after coating (particularly, spray coating) is performed (a detailed description of the amorphous structure is as described above). In addition, the iron-based amorphous alloy powder may be produced by a gas atomizer method, and specifically, the iron-based amorphous alloy powder may be produced while being sprayed in a molten state from an atomizer under the atmosphere of an inert gas such as helium, nitrogen, neon, or argon, and being cooled. When manufactured in this manner, a fully amorphous powder (that is, 100% amorphous phase) may be produced. That is, a special alloy powder having a 100% amorphous phase, which has an atomic structure different from those of existing alloy powder particles, may be produced. In addition, a detailed description of the iron-based amorphous alloy powder is as described above.

For example, the iron-based amorphous alloy powder may be applied to a spray coating process to form a coating layer or a coating film on an object.

Spray coating refers to a method of heating a metal or a metal compound to form a fine volumetric shape and spraying fine droplets of the metal or the metal compound onto the surface of a workpiece, and examples of spray coating include HVOF spray coating, plasma spray coating, laser cladding spray coating, general frame spray coating, diffusion spray coating, cold spray coating, vacuum plasma spray (VPS) coating, low-pressure plasma spray (LPPS) coating, and the like.

Spray coating is a process of forming a coated body by melting iron-based amorphous alloy powder and coating a body with the molten iron-based amorphous alloy powder, and because the amorphous alloy powder exposed to high temperature and melted is not rapidly cooled, the molten amorphous alloy powder may be entirely or partially crystalized during the process, resulting in a low amorphous fraction.

Therefore, in the related art, although amorphous metal powder particles have a high amorphous fraction, coatings formed of the amorphous metal powder particles do not have good amorphous characteristics.

However, since the iron-based amorphous alloy powder of the present disclosure has a good amorphous forming ability even without rapid cooling, the amorphous fraction in a coating formed of the iron-based amorphous alloy powder is not lowered even after the abovementioned surface treatment.

That is, when the iron-based amorphous alloy powder having an amorphous phase fraction of 90% or more, 99% or more, 99.9% or more, or substantially 100% is used to form a coating by spray coating, the coating may have very good characteristics because the coating has an amorphous phase volume fraction of 90% or more, 95% or more, 99% or more, 99.9% or more, or substantially 100% with respect to the entire structure. In particular, when an HVOF spray coating process is performed using the alloy powder of the present disclosure, the amorphous phase fraction is substantially maintained, and thus physical properties may be maximally improved.

The spray coating method described above may be a conventional method known in the related art, and the operating conditions or environments of the spray coating method may also be substantially the same as conventional operating conditions or environments of the related art. For example, Sulzer Metco Diamond Jet or similar equipment may be used, and conditions such as oxygen flow, propane flow, air flow, feeder rates, and nitrogen flow may be properly adjusted.

Specifically, the spray coating process allows the alloy layer to be maintained in an amorphous state even after coating with the iron-based amorphous alloy powder, and may be performed by a method selected from the group consisting of HVOF spray coating, plasma spray coating, vacuum plasma spray coating, and arc wire spray coating. When such a spray coating process is performed, a structure in which multiple paths are accumulated may be formed. Specifically, oxides (black) may be accumulated in each layer, and a plurality of layers having a wave form may be stacked on a plate. In general, such a structure deteriorates or worsens the properties of a coating layer. However, the alloy layer (coating layer) of the present disclosure may have substantially no or minimal pores/oxide film, and thus properties of the alloy layer such as hardness, corrosion resistance, and wear resistance may also be improved.

In addition, the iron-based amorphous alloy powder has a very high density (coating density) on the level of 98% to 99.9% when measured, and thus the penetration of corrosives through pores may be suppressed.

The particle size of the alloy powder used for spray coating may be within the range of 10 μm to 100 μm, and preferably within the range of 15 μm to 55 μm. If the particle size of the alloy powder is less than 10 μm, there is a risk of decreasing work efficiency because small particles may adhere to a spray coating gun during a spray coating process, and if the particle size of the alloy powder exceeds 100 μm, coating productivity and efficiency may decrease because the alloy powder may not completely melt and collide with the base member (that is, the alloy powder may fall to the floor instead of forming a coating).

In addition, the Vickers hardness (Hv 0.2) of the iron-based amorphous alloy may be 700 to 1,200 and preferably 800 to 1,000. The friction coefficient (friction resistance) of the iron-based amorphous alloy may be 0.001μ to 0.08μ and preferably 0.05μ or less under a load of 100 N, and may be 0.06μ to 0.12μ and preferably 0.10μ or less under a load of 1,000 N.

In particular, compared to conventional coatings, a coating formed by an HVOF spray coating process has substantially no pores in a cross-section thereof, and may thus have maximal density (full density) or a porosity of only about 0.1% to 1.0% even when having pores.

That is, when an HVOF spray coating is performed, a structure in which multiple paths are accumulated is formed. Specifically, oxides (black) are accumulated in each layer, and a plurality of layers having a wave form are stacked. In general, such a structure deteriorates or worsens the properties of coatings. However, the coating of the present disclosure may have substantially no pores/oxide film and thus may have ultra-high density, such that the performance of the coating may be improved. In addition, the wear resistance, corrosion resistance, elasticity, and friction resistance of the coating including the iron-based amorphous alloy powder are also very good compared to those of coatings formed of conventional alloy powder.

In addition, the thickness of the iron-based amorphous alloy coated on the base member may be 0.05 mm to 0.5 mm, preferably 0.1 mm to 0.2 mm, and more preferably 0.075 to 0.125 mm. If the thickness of the iron-based amorphous alloy is outside the range, the characteristics of the coating layer of the present disclosure may not be satisfied. The iron-based amorphous alloy may be coated on the entire surface of the base member or only a portion of the surface of the base member in a striking direction.

In addition, if necessary, the iron-based amorphous alloy may be formed in various patterns, such as a grid pattern.

In addition, the iron-based amorphous alloy powder, which is a raw material of the iron-based amorphous alloy, may be manufactured by a gas atomizer method. Specifically, the iron-based amorphous alloy powder may be manufactured while being sprayed in a molten state from an atomizer under the atmosphere of an inert gas such as helium, nitrogen, neon, or argon, and being cooled. When manufactured in this manner, a high-purity amorphous alloy powder may be obtained, which has an atomic structure different from those of existing alloy powder particles.

Next, the physical properties of the iron-based amorphous alloy formed on the surface of the base member will be described. The Vickers hardness (Hv 0.2) of the iron-based amorphous alloy may be 700 to 1,200, and preferably 800 to 1,000. The coefficient of friction (friction resistance) of the iron-based amorphous alloy may be 0.0005μ to 0.08μ and preferably 0.001μ to 0.05μ under a load of 100 N, and may be 0.01μ to 0.12μ and preferably 0.03μ to 0.10μ under a load of 1,000 N. In addition, the iron-based amorphous alloy formed by an HVOF spray coating process has substantially no pores in a cross-section thereof, and may thus have a full density of 99% to 100%, preferably 99.5% to 100%, and more preferably 99.8% to 100%, and even when the iron-based amorphous alloy has pores, the iron-based amorphous alloy may have a porosity of only about 0.2% to 1.0%.

That is, when (HVOF) spray coating is performed, a structure in which multiple paths are accumulated may be formed. Specifically, oxides (black) may be accumulated in each layer, and a plurality of layers having a wave form may be stacked. In general, such a structure deteriorates or worsens the properties of a coating layer. However, the coating layer of the present disclosure may have substantially no or minimal pores/oxide film, and thus properties of the coating layer such as hardness, corrosion resistance, and wear resistance may also be improved. In addition, the coated body of the present disclosure may have any conventional shape of coated bodies and is not limited to a particular size or shape.

Mode for Invention

The present disclosure is to manufacture a novel coated body by coating a body (base member) made of a general material with a high-hardness/low-friction amorphous alloy (of which the hardness is two or more times the hardness of a general base member), thereby improving the durability, corrosion resistance, friction characteristics, and wear characteristics of the base member.

Hereinafter, preferred examples are presented to help the understanding of the present disclosure, but the following examples are merely for illustrative purposes. It will be apparent to those skilled in the art that various changes and modifications may be made within the scope and spirit of the present disclosure, and such changes and modifications are within the scope of the appended claims.

EXAMPLES

Examples 1 to 8: Fabrication of Iron-Based Amorphous Alloy Powder Particles

Materials having components and compositions (weight ratios) illustrated in Table 1 below were fed into an atomizer under a nitrogen gas atmosphere, atomized in a molten state, and cooled at cooling rates illustrated in Table 1 below, so as to fabricate iron-based amorphous alloy powder particles according to Examples 1 to 8.

TABLE 1

| Components | Example 1 | Example 2 | Example 3 | Example 4 | Example 5 | Example 6 | Example 7 | Example 8 |
|---|---|---|---|---|---|---|---|---|
| Fe | 1 | 1 | 1 | 1 | 1 | 1 | 1 | 1 |
| Cr | 0.55 | 0.26 | 0.355 | 0.292 | 0.374 | 0.355 | 0.292 | 0.374 |
| Mo | 0.84 | 0.36 | 0.645 | 0.502 | 0.411 | 0.645 | 0.502 | 0.411 |
| C | 0.06 | — | 0.092 | — | .056 | 0.092 | 0.080 | 0.056 |
| B | — | 0.04 | — | 0.04 | — | 0.1 | 0.092 | 0.04 |
| Cooling rate (degrees/sec) | $10^4$ | $10^4$ | $10^4$ | $10^3$ | $10^3$ | $10^2$ | $10^2$ | $10^2$ |
| *Average diameter of powder particles | 5 | 5 | 10 | 20 | 20 | 50 | 50 | 50 |

*D50 (Unit: μm)

As illustrated in Table 1, according to the examples of the present disclosure, the alloy powder particles having an average particle diameter of 5 μm to 50 μm and including first to fourth components in specific amounts were fabricated by cooling at a rate of $10^1$ to $10^4$ degrees/sec.

Fabrication Example 1: Preparation of Base Member of Coated Body

A tool formed of Ti and having a thickness of 3 mm was prepared by CNC milling as a base member for a commonly used coated tool.

Examples 9 to 16: Formation of Iron-Based Amorphous Alloy Layers (Coating Layers)

The surface of the base member fabricated according to Fabrication Example 1 was coated with the iron-based amorphous alloy powder particles of Examples 1 to 8 by spray coating so as to fabricate coated bodies having iron-based amorphous powder layers having a thickness of 0.1 mm.

Specifically, the spray coating was performed using Sulzer Metco Diamond Jet under the conditions of an oxygen flow rate of 45%, a propane flow rate of 48%, an air flow rate of 52%, a feeder rate of 336%, a nitrogen flow rate of 15 to 20 RPM, and stand-off 12 inches.

Comparative Examples 1 to 7: Fabrication of Iron-Based Alloy Powder Particles Materials having components and compositions (weight ratios) illustrated in Table 2 below were fed into an atomizer under a nitrogen gas atmosphere, atomized in a molten state, and cooled at cooling rates illustrated in Table 2 below, so as to fabricate iron-based alloy powder particles according to Comparative Examples 1 to 7.

TABLE 2

| Components | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Fe | 1 | 1 | 1 | 1 | 1 | 1 | 1 |
| Cr | 0.56 | 0.20 | 0.714 | 0.714 | 0.550 | 0.411 | 0.196 |
| Mo | 0.30 | 0.85 | 0.345 | 0.245 | 0.183 | 0.374 | 0.686 |
| C | — | — | 0.020 | 0.060 | 0.028 | 0.028 | 0.020 |
| B | — | 0.04 | — | — | 0.073 | 0.056 | 0.059 |
| Cooling rate (degrees/sec) | $10^4$ | $10^4$ | $10^4$ | $10^3$ | $10^2$ | $10^2$ | $10^2$ |
| *Average particle diameter of powder | 5 | 5 | 10 | 20 | 50 | 50 | 50 |

*D50 (Unit: μm)

As illustrated in Table 2, according to the fabrication examples of the present disclosure, the alloy powder particles having an average particle diameter of 5 μm to 50 μm and including first to fourth components in specific amounts were fabricated by cooling at a rate of $10^1$ to $10^4$ degrees/sec.

Fabrication Example 2: Preparation of Coated Body

A body formed of the same material as in Fabrication Example 1 and having a thickness of 3.0 mm was prepared as a commonly used body (not coated with iron-based amorphous alloy powder).

Comparative Examples 8 to 14: Formation of Coating Layers Using Iron-Based Alloy Powder Particles The surface of the body prepared according to Fabrication Example 2 was coated with the alloy powder particles of Comparative Examples 1 to 7 by spray coating in the same manner as in the examples of the present disclosure, so as to fabricate a coated body on which a coating layer having a thickness of 0.1 mm was provided.

Hereinafter, the case of using the coated body of Fabrication Example 2 will be referred to as Comparative Example 15 for ease of illustration.

Experimental Example 1: Evaluation of Amorphousness of Alloy Powder Particles

Results of XRD measurement of the iron-based amorphous alloy powder particles of the examples are illustrated in FIGS. 1A to 1E. FIGS. 1A to 1E are XRD graphs of the iron-based amorphous alloy powder particles of Examples 1, 3, 6, 7, and 8 of the present disclosure, respectively. Referring to FIGS. 1A to 1E, Examples 1, 3, 6, 7, and 8 each have a 2 theta (2θ) value which broadly peaks within the range of 40 degrees to 50 degrees, and thus it may be understood that all of Examples 1, 3, 6, 7, and 8 have an amorphous phase.

In addition, results of XRD measurement of the iron-based amorphous alloy powder particles of comparative examples are illustrated in FIGS. 2A to 2C. FIGS. 2A to 2C are XRD graphs of the iron-based alloy powder particles of Comparative Examples 1, 5, and 7, respectively. Referring to FIGS. 2A to 2C, Comparative Examples 1, 5 and 7 each have a 2 theta (2θ) value which has a steep first peak within the range of 40 degrees to 50 degrees and at least a second peak within the range of 65 degrees to 70 degrees, and thus it may be understood that Comparative Examples 1, 5 and 7 have an amorphous phase and a partial crystalline phase.

In particular, considering the height of the second peak, it may be confirmed that the amount of a crystalline phase increases from Comparative Example 7 to Comparative Example 5, that is, from FIG. 2C to FIG. 2A.

Experimental Example 2: Evaluation of Amorphousness of Coatings

FIGS. 3A to 3D are SEM analysis images of the iron-based amorphous alloy powder (atomized) of Example 7 and a cross-section thereof, and SEM analysis images of the iron-based alloy powder (atomized) of Comparative Example 7 and a cross-section thereof. FIGS. 3A and 3B correspond to the iron-based amorphous alloy powder (atomized) of Example 7 and a cross-section thereof, and FIGS. 3C and 3D correspond to the iron-based alloy powder (atomized) of Comparative Example 7 and a cross-section thereof.

Referring to FIG. 3B, no microstructure is observed in the example, and therefore it may be seen that the porosity is substantially 0%. However, referring to FIG. 3D, many microstructures are observed in the comparative example.

In addition, FIGS. 4A to 4E are amorphous XRD graphs of coating specimens formed of the iron-based amorphous alloy powder particles of Examples 9 to 16. That is, FIGS. 4A to 4E are XRD graphs of coating specimens obtained according to Examples 9, 11, 14, 15, and 16 by respectively using the iron-based amorphous alloy powder particles of Examples 1, 3, 6, 7, and 8. Referring to FIGS. 4A to 4E, in each of the XRD graphs of the examples, no additional peak was present together with a first peak, and thus it could be seen that the powder particles of the present disclosure had an amorphous structure.

In addition, FIGS. 5A to 5C are XRD graphs of coating specimens formed of iron-based alloy powder particles fabricated according to comparative examples. That is, FIGS. 5A to 5C are XRD graphs of coating specimens obtained according to Comparative Examples 8, 12, and 14 by respectively using the iron-based alloy powder particles of Comparative Examples 1, 5, and 7. Referring to FIGS. 5A to 5C, in the XRD graphs of the comparative examples, additional peaks were present together with steep first peaks, and thus it was confirmed that the powder particles had no amorphous phase structure.

That is, through this, it may be seen that the alloy powder particles of the present disclosure have a much stronger amorphous forming ability than the alloy powder particles of the comparative examples.

As a result of comparing the XRD graphs of FIG. 1 and the XRD graphs of FIG. 3, it was confirmed that the amorphous structures of the powder particles of the examples illustrated in FIG. 1 were maintained after the powder particles were formed as coatings as illustrated in FIG. 3.

Particularly in the current experimental example, it may be confirmed that coatings in which an amorphous phase is entirely formed (in an amount of 95 volume % or more) may be formed by an HVOF spray coating method.

Experimental Example 3: Macroscopic Quality Evaluation of Sprayed Coatings Formed of Alloy Powder Particles FIGS. 6A to 6G are surface images of sprayed coatings formed of the iron-based amorphous alloy powder particles of the present disclosure, and surface images of sprayed coatings formed of the alloy powder particles of comparative examples. FIGS. 6A to 6C are surface images of sprayed coatings of Examples 9, 15, and 16 formed of the iron-based amorphous alloy powder particles of Examples 1, 7, and 8. FIGS. 6D to 6G are surface images of sprayed coatings of Comparative Examples 8, 10, 12, and 14 formed of the alloy powder particles of Comparative Examples 1, 3, 5, and 7.

Referring to FIGS. 6A to 6G, the coating of Comparative Example 14 (see FIG. 6G) had poor surface quality, and the coatings of the other examples and comparative examples had exceptional or good surface quality.

Experimental Example 4: Microscopic Quality Evaluation of Sprayed Coatings Formed of Alloy Powder Particles FIGS. 7A to 7D are optical microscopic images (Leica DM4 M) of cross-sections of sprayed coating specimens of Examples 9, 11, 14, and 16 of the present disclosure formed of the iron-based amorphous alloy powder particles of Examples 1, 3, 6, and 8 of the present disclosure. FIGS. 8A to 8C are optical microscopic images of cross-sections of sprayed coating specimens of Comparative Examples 8, 11, and 14 formed of the alloy powder particles of Comparative Examples 1, 4, and 7. It may be seen that the cross-sections of the sprayed coatings of Examples 9, 11, 14, and 16 all have high density.

However, referring to FIGS. 8A to 8C, it may be seen that the cross-sections of the sprayed coatings of Comparative Examples 8, 11, and 14 include a large number of unmelted particles and a large amount of gray phase, and has layer-layer characteristics.

Experimental Example 5: Hardness Evaluation of Sprayed Coatings Formed of Alloy Powder Particles A micro-hardness test was performed on cross-sections of specimens of the sprayed coatings of Examples 11, 14, and 16 and Comparative Examples 8, 10, 12, and 14 by using an HVS-10 digital low load Vickers hardness tester Machine, and results thereof are illustrated in Table 3 below.

TABLE 3

| Examples | area | Test value $HV_{0.2}$ | Average $HV_{0.2}$ |
|---|---|---|---|
| Example 11 | Cross-section | 802/754/828/765/710 | 771 |
| Example 14 | Cross-section | 898/834/944/848/789 | 862 |
| Example 16 | Cross-section | 1304/1139/1097/1194/1139 | 1174 |
| Comparative Example 8 | Cross-section | 669/756/623/689/683 | 684 |
| Comparative Example 10 | Cross-section | 928/862/876/921/802 | 877 |
| Comparative Example 12 | Cross-section | 828/848/1012/944/771 | 880 |
| Comparative Example 14 | Cross-section | 821/855/808/783/633 | 780 |

As illustrated in Table 3, the cross-section of the specimen formed of the alloy powder of Example 16 had the highest average hardness, and the other examples resulted in hardness values similar to those in the comparative examples.

Experimental Example 6: Evaluation of Corrosion Resistance of Spray Coatings Formed of Alloy Powder Particles FIGS. 9A to 9C are optical microscopic images of uncorroded and corroded cross-sections of sprayed coating specimens of Examples 10, 12, and 15 of the present disclosure formed of the iron-based amorphous alloy powder particles of Examples 2, 4, and 7 of the present disclosure. FIGS. 10A to 10C are optical microscopic images of uncorroded and corroded cross-sections of sprayed coating specimens of Comparative Examples 8, 11, and 13 formed of the alloy powder particles of Comparative Examples 2, 4, and 6 of Comparative Examples.

Specifically, after the spray coating specimens were immersed in a 95% to 98% sulfuric acid (H2SO4) solution at room temperature for 5 minutes, cross-sections and surfaces of uncorroded and corroded coating specimens were observed using an optical microscope (Leica DM4 M). In FIGS. 9A to 9C and 10A to 10C, the left sides illustrate uncorroded specimens, and the right sides illustrate corroded specimens.

As a result of observation, as illustrated in FIGS. 9A to 9C, it could be confirmed that the coating specimens of Examples 10, 12, and 15 had no significant difference in appearance before and after immersion in the sulfuric acid solution and thus had very good corrosion resistance.

However, the coating specimens of Comparative Examples 8, 11, and 13 markedly corroded and thus had very poor corrosion resistance as illustrated in FIGS. 10A to 10C.

These results are due to whether the coating specimens are amorphous. That is, the coatings of the examples did not react at all with the strong acid corrosive, whereas the coatings of the comparative examples containing a crystalline phase reacted with the corrosive and corroded, thus exhibiting poor corrosion resistance.

Experimental Example 7: Evaluation of Friction of Sprayed Coatings Formed of Alloy Powder Particles In order to evaluate friction (coefficient of friction), the alloy powder coating specimens fabricated in Examples 14 to 16 and Comparative Examples 11 to 14 were subjected to a metal ring-lump test under a lubricating oil condition to measure wear widths. Specifically, the metal ring-lump test was performed using an MR-H3A high-speed ring-lump wear machine with an L-MM46 resistance-friction hydromantic lubricating oil, and test parameters were varied in the order of 50 N, 5 min→100 N, 25 min→1000 N, 55 min.

The friction coefficients of specimens measured with parameters of 100N, 25 min and 1000N, 55 min are illustrated in Table 4 below, and results of wear width measurement are illustrated in Table 5 below.

TABLE 4

| | 100N, 25min | | 1000N, 55min | |
|---|---|---|---|---|
| Examples | Friction coefficient (μ) | Average friction coefficient (μ) | Friction coefficient (μ) | Average friction coefficient (μ) |
| Example 9 | 0.001-0.007 | 0.0044 | 0.040-0.078 | 0.0692 |
| Example 14 | 0.005-0.024 | 0.0127 | 0.007-0.095 | 0.0860 |
| Example 15 | 0.006-0.028 | 0.0135 | 0.007-0.098 | 0.0882 |
| Comparative Example 8 | 0.030-0.054 | 0.0419 | 0.101-0.119 | 0.1123 |
| Comparative Example 10 | 0.008-0.047 | 0.0196 | 0.088-0.116 | 0.0913 |
| Comparative Example 12 | 0.065-0.087 | 0.0820 | 0.098-0.111 | 0.1085 |

TABLE 5

| Examples | Width/mm |
|---|---|
| Example 9 | 0.79 |
| Example 14 | 0.75 |
| Example 15 | 0.71 |
| Comparative Example 8 | 0.98 |
| Comparative Example 10 | 1.15 |
| Comparative Example 12 | 0.82 |

Comparing the results illustrated in Tables 4 and 5, it may be seen that, on average, the coatings of Examples 9 and 14 have a low coefficient of friction, and the coatings of Comparative Examples 8 and 10 have a very high coefficient of friction. In addition, referring to FIG. 11 and Table 5, it may be seen that the examples have small wear widths, and the comparative examples have relatively large wear widths.

Experimental Example 8: Evaluation of Wear Resistance of Iron-Based Amorphous Alloys Coated on Bodies In order to evaluate wear resistance, the coating specimens of Examples 16 to 18 and Comparative Example 15 were subjected to a metal ring-lump test under a lubricating oil condition to measure wear widths.

Specifically, the metal ring-lump test was performed using an MR-H3A high-speed ring-lump wear machine with an L-MM46 resistance-friction hydromantic lubricating oil, and test parameters were varied in the order of 50 N, 5 min→100 N, 25 min→1000 N, 55 min. Wear widths and friction coefficients are illustrated in Tables 8 and 9 below (the friction coefficients of specimens with parameters of 100 N, 25 min and 1000 N, 55 min are illustrated in Table 6 below, and results of wear width measurement are illustrated in Table 7 below).

TABLE 6

| | 100 N, 25 min | | 1000 N, 55 min | |
|---|---|---|---|---|
| | Friction coefficient (μ) | Average friction coefficient (μ) | Friction coefficient (μ) | Average friction coefficient (μ) |
| Example 16 | 0.001-0.007 | 0.0044 | 0.04-0.078 | 0.0692 |
| Example 17 | 0.005-0.024 | 0.0127 | 0.07-0.095 | 0.0860 |
| Example 18 | 0.02-0.053 | 0.0364 | 0.099-0.117 | 0.1089 |
| Comparative Example 15 | — | — | — | — |

TABLE 7

| | Width/mm |
|---|---|
| Example 16 | 0.79 |
| Example 17 | 0.75 |
| Example 18 | 0.71 |
| Comparative Example 15 | — |

While embodiments of the present disclosure have been described above, the embodiments are merely examples, and those of ordinary skill in the art will understand that various modifications could be made in the embodiments, and various equivalent embodiments could be may be provided from the embodiments. For example, in the present specification, the composition of alloy powder of an embodiment refers to an example ratio of components of the alloy powder and does not preclude the addition of other metals or inevitable process impurities as long as the ratio of the components is maintained. Thus, the technical scope of the present disclosure should be defined by the following claims.

The invention claimed is:

1. A coated body comprising:

a base member; and a coating layer formed of an iron-based amorphous alloy and provided on a surface of the base member, wherein the iron-based amorphous alloy has an amorphous structure and comprises: 25.4 to 55.3 parts by weight of chromium, 35.6 to 84.2 parts by weight of molybdenum, based on 100 parts by weight of iron; and wherein the iron-based amorphous alloy comprises either one of carbon or boron, but not both, wherein carbon is comprised in the amount of 4 to 9.2 parts by weight and boron is comprised in the amount of 4 to 9.2 parts by weight, based on 100 parts by weight of iron, wherein the coated body comprises either one of boride and carbide, but not both, and the total content of boride and carbide in the coated body is 3 to 8 parts by weight based on 100 parts by weight of iron.

2. The coated body of claim 1, wherein the base member has a material selected from a metal, a cermet, a ceramic, a plastic, and a fiber composite.

3. The coated body of claim 1, wherein the boride and the carbide are derived from carbon/boron in an iron-based amorphous alloy powder of the iron-based amorphous alloy.

4. The coated body of claim 1, wherein the coating layer is formed by spray coating of powder of the iron-based amorphous alloy.

5. The coated body of claim 4, wherein the coating layer has a thickness of 0.01 mm to 0.5 mm, and the base member has a thickness of 10 mm to 100 mm.

6. The coated body of claim 5, wherein the powder of the iron-based amorphous alloy has an amorphous phase fraction of 90 volume % to 100 volume %.

7. The coated body of claim 6, wherein the coating layer has an amorphous phase fraction of 90 volume % to 100 volume %.

8. The coated body of claim 7, wherein the iron-based amorphous alloy has a Vickers hardness of 700 to 1,500 Hv (0.2).

9. The coated body of claim 8, wherein the iron-based amorphous alloy has a friction coefficient of 0.0005μ to 0.08μ under a load of 100 N, and 0.01μ to 0.12μ under a load of 1,000 N.

10. The coated body of claim 9, wherein the iron-based amorphous alloy further comprises one selected from the group consisting of tungsten, cobalt, yttrium, manganese, silicon, aluminum, niobium, zirconium, phosphorus, nickel, scandium, titanium, copper, and mixtures thereof.

* * * * *